US011022311B2

(12) United States Patent
Uhm et al.

(10) Patent No.: US 11,022,311 B2
(45) **Date of Patent: *Jun. 1, 2021**

(54) FUEL NOZZLE WITH TURNING GUIDE AND GAS TURBINE INCLUDING THE SAME

(71) Applicant: DOOSAN HEAVY INDUSTRIES & CONSTRUCTION CO., LTD., Changwon-si (KR)

(72) Inventors: Jongho Uhm, Yongin-si (KR); Jeongmin Kim, Seoul (KR)

( * ) Notice: Subject to any disclaimer, the term of this patent is extended or adjusted under 35 U.S.C. 154(b) by 205 days.

This patent is subject to a terminal disclaimer.

(21) Appl. No.: 16/008,029

(22) Filed: Jun. 14, 2018

(65) Prior Publication Data

US 2019/0011129 A1 Jan. 10, 2019

(30) Foreign Application Priority Data

Jul. 4, 2017 (KR) ..... 10-2017-0085080

(51) Int. Cl.
*F23R 3/26* (2006.01)
*F23R 3/14* (2006.01)
(Continued)

(52) U.S. Cl.
CPC ..... *F23R 3/26* (2013.01); *F23R 3/14* (2013.01); *F23R 3/16* (2013.01); *F23R 3/286* (2013.01); *F23R 3/38* (2013.01); *F23R 3/46* (2013.01)

(58) Field of Classification Search
CPC ..... F23R 3/14; F23R 3/16; F23R 3/24; F23R 3/26; F23R 3/286; F23R 3/38; F23R 3/46
See application file for complete search history.

(56) References Cited

U.S. PATENT DOCUMENTS 7,841,180 B2 * 11/2010 Kraemer ..... F02C 7/22 60/39.822
8,752,386 B2 * 6/2014 Fox ..... F23R 3/286 60/737
(Continued)

FOREIGN PATENT DOCUMENTS

JP 2017-053276 A 3/2017
KR 10-1999-0054621 A 7/1999
(Continued)

OTHER PUBLICATIONS

A Korean Office Action dated Jul. 2, 2018 in connection with Korean Patent Application No. 10-2017-0085080 which corresponds to the above-referenced U.S. application.

*Primary Examiner* — Arun Goyal

(57) ABSTRACT

A fuel nozzle with turning guide is included in a gas turbine. The turning guide is disposed in an air inlet of the fuel nozzle to distribute a flow of compressed air and includes at least one of a turning separator, an inner separator, and an outer separator. The fuel nozzle includes a central body having an outer wall; a shroud concentrically disposed with respect to the central body and configured to surround the central body while maintaining a space for an air passage between an inner wall of the shroud and the outer wall of the central body; a rim formed on one end of the shroud and forming an air inlet communicating with the air passage; and a turning guide including a turning separator disposed in the air inlet, to make the air flow uniform, thereby suppressing the creation of an air pocket.

6 Claims, 15 Drawing Sheets

(51) Int. Cl.

| | |
|---|---|
| ***F23R 3/46*** | (2006.01) |
| ***F23R 3/38*** | (2006.01) |
| ***F23R 3/16*** | (2006.01) |
| ***F23R 3/28*** | (2006.01) |

(56) References Cited

U.S. PATENT DOCUMENTS

| | | | | |
|---|---|---|---|---|
| 10,107,501 | B2 * | 10/2018 | Takiguchi | F23R 3/14 |
| 2012/0024985 | A1 * | 2/2012 | Johnson | F23R 3/286<br>239/518 |
| 2013/0061594 | A1 | 3/2013 | Stewart | |
| 2014/0338354 | A1 | 11/2014 | Stewart et al. | |
| 2017/0074519 | A1 * | 3/2017 | Abe | F23R 3/10 |

FOREIGN PATENT DOCUMENTS

| | | | |
|---|---|---|---|
| KR | 10-1188639 | B1 | 10/2012 |
| KR | 10-2014-0082659 | A | 7/2014 |

* cited by examiner

FUEL NOZZLE WITH TURNING GUIDE AND GAS TURBINE INCLUDING THE SAME

CROSS-REFERENCE TO RELATED APPLICATIONS

This application claims priority to and the benefit of Korean Patent Application No. 10-2017-0085080 filed in the Korean Intellectual Property Office on Jul. 4, 2017, the entire contents of which are incorporated herein by reference.

BACKGROUND OF THE INVENTION

Field of the Invention

The present invention relates to a fuel nozzle with a turning guide and a gas turbine including the fuel nozzle and the turning guide, and more particularly to the fuel nozzle in which the airflow of compressed air introduced into the fuel nozzle is guided by the turning guide.

Description of the Related Art

A gas turbine is a power engine that generates a hot gas through combustion of a compressed air and a fuel. The gas turbine rotates a turbine with the hot gas. The gas turbine is used for a combined-cycle power generation and a cogeneration.

The gas turbine is roughly divided into a compressor, a combustor, and a turbine. The compressor compresses an incoming air to a high pressure by receiving a part of power generated from a rotation of the turbine. The compressed air is transmitted to the combustor. The combustor mixes and burns the compressed air with the fuel to generate a flow of high-temperature combustion gas and injects it into the turbine. The injected combustion gas rotates the turbine to obtain a rotational force.

Specifically, the air compressed by the compressor flows into the combustor, and the fuel is injected through swirl vanes arranged in each fuel nozzle and is then mixed with the air. A mixture of fuel and air is burned in a combustion chamber located at a downstream of each fuel nozzle assembly, and the combustion gas is discharged through a hot gas path within the turbine.

Meanwhile, it is important to maintain uniform airflow as the compressed air is introduced into the fuel nozzle assembly and as the air is supplied to the fuel nozzles. This uniform flow of air is needed to uniformly mix the air with the fuel. Further, in order to make a stable combustion, it is needed to combust the uniform mixture of the air and fuel.

However, when the compressed air is introduced into the fuel nozzle assembly, the directionality of the airflow is inherently changed. Also, a small region can be created at where the airflow is slowed or the pressure is low, i.e., an air pocket. A region, where the flow rate of air through a fuel nozzle is low, may cause a flame anchoring in the fuel nozzles, thereby damaging fuel nozzle components. In addition, the low flow of air supplied to the fuel nozzle may invite partial changes in the mixture of air and fuel, thus increasing a combustion temperature or creating excessive nitrogen oxides (NOx).

SUMMARY OF THE INVENTION

Accordingly, it is an object of the present invention to provide a fuel nozzle in which a turning guide enables a uniform flow of air when compressed air is supplied to the fuel nozzle, thereby preventing creation of an air pocket, to provide the turning guide for the same, and to provide a gas turbine including the fuel nozzle with turning guide.

It is an object of the present invention to provide a fuel nozzle in which a turning guide facilitates a more uniform supply of air into the fuel nozzle, thereby realizing stable combustion and reducing nitrogen oxides, to provide the turning guide for the same, and to provide a gas turbine including the fuel nozzle with turning guide.

According to an embodiment of the present invention, a fuel nozzle may include a central body having an outer wall; a shroud concentrically disposed with respect to the central body and configured to surround the central body while maintaining a space for an air passage between an inner wall of the shroud and the outer wall of the central body; a rim formed on one end of the shroud and forming an air inlet communicating with the air passage; and a turning guide including a turning separator disposed in the air inlet.

The turning separator may have an angle of coverage of the rim in a circumferential direction of 40 to 240 degrees.

The turning guide may further include at least one outer separator connected to a lateral end of the turning separator and extending outwardly from the turning separator in a radial direction, and at least one inner separator connected to a lateral end of the turning separator and extending inwardly from the turning separator in a radial direction. The at least one outer separator may be connected to the lateral end of the turning separator and extending outwardly from the turning separator in the radial direction.

At least one of the turning separator, the inner separator, and the outer separator may have a plurality of openings formed according to a pattern.

A horizontal length of a downstream end of the inner separator and a horizontal length of a downstream end of the outer separator may have a ratio of 4:1 to 1:1.

The turning separator may have at least one opening. The at least one opening may be arranged according to an airflow travel distance.

The turning guide may further include at least one plate-shaped separator connected to a lateral end of the turning separator and extending from the turning separator in a radial direction. The at least one plate-shaped separator may be formed in a streamlined shape.

The outer separator may be tilted at an angle of ±10 degrees in a circumferential direction of the turning separator.

The turning separator may have a lower portion formed to be inclined with respect to one of the central body and the shroud.

The fuel nozzle may further include a plurality of swirl vanes disposed at a specific interval on an outer circumferential surface of the central body, wherein a lower end of the turning guide is spaced apart from an upper end of the plurality of swirl vanes.

According to an embodiment of the present invention, a turning guide may be disposed in the above fuel nozzle and may include a turning separator, disposed in the air inlet and arranged along a circumferential direction of the air inlet, including a lower portion facing an inner wall of the shroud and an upper portion facing an outer surface of the rim.

According to an embodiment of the present invention, a fuel nozzle assembly may comprise a plurality of the above fuel nozzles.

According to an embodiment of the present invention, a gas turbine may include a compressor for compressing incoming air; a combustor for mixing fuel with the compressed air and burning the mixture, the combustor including a combustion chamber and a fuel nozzle assembly disposed in the combustion chamber; and a turbine for generating a turning force by a combustion gas received from the combustor, wherein the fuel nozzle assembly includes a plurality of the above fuel nozzles.

It is to be understood that both the foregoing general description and the following detailed description of the present invention are exemplary and explanatory and are intended to provide further explanation of the invention as claimed.

BRIEF DESCRIPTION OF THE DRAWINGS

The above and other objects, features and other advantages of the present invention will be more clearly understood from the following detailed description taken in conjunction with the accompanying drawings, in which.

DETAILED DESCRIPTION OF THE INVENTION

Figure 1:
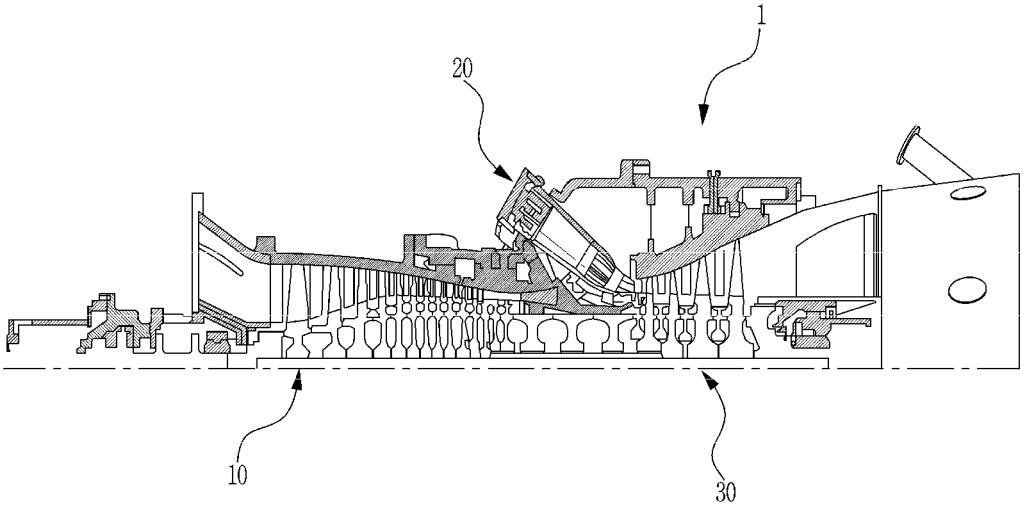
FIG. 1 is a schematic view illustrating a gas turbine including a fuel nozzle assembly according to an embodiment of the present invention.

Hereinafter, various embodiments of the present invention will be described in detail with reference to the accompanying drawings. It should be understood that the present invention is not intended to be limited to embodiments disclosed herein and includes various modifications, equivalents, and/or alternatives of the disclosed embodiments.

Terminology used herein is merely for the purpose of describing particular embodiments and is not intended to limit the invention. Singular forms utilizing "a," "an," and "the" are intended to include plural forms unless the context clearly dictates otherwise. In addition, terms such as "comprise," "include," and "have" are intended to specify the presence of stated elements, components, operations, functions, features, steps, or the like, without excluding the presence or possibility of additional other elements, components, operations, functions, features, steps, or the like.

The following description of embodiments may omit descriptions of techniques that are well known in the art or not directly related to the present disclosure. This is to clearly convey the subject matter of the present disclosure by omitting unnecessary explanation. For the same reason, some elements in the drawings may be exaggerated, omitted, or schematically illustrated. Also, the size of each element does not entirely reflect the actual size. In the drawings, the same or corresponding elements are denoted by the same reference numerals.

Referring to FIG. 1, a gas turbine 1 according to an embodiment of the present invention may include a compressor 10 for compressing incoming air with a high pressure, a combustor 20 for mixing and burning the compressed air and fuel, and a turbine 30 for generating a turning force by a combustion gas. The combustor 20 includes a fuel nozzle assembly, which includes a plurality of fuel nozzles.

Figure 2:
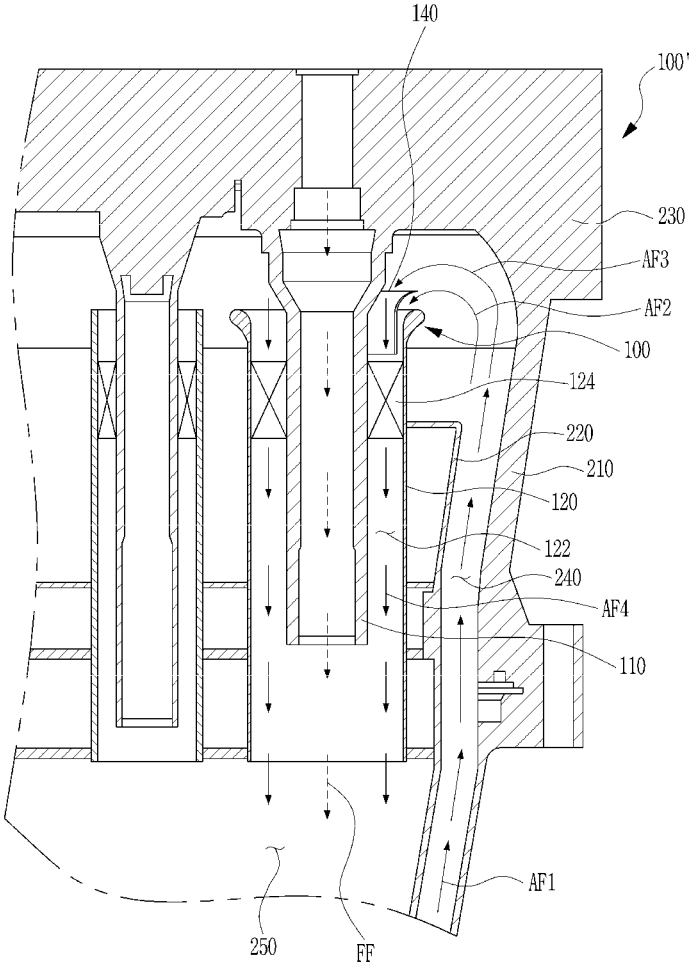
FIG. 2 is a cross-sectional view schematically showing a fuel nozzle assembly according to an embodiment of the present invention.

Referring to FIG. 2, a fuel nozzle assembly 100' may include a casing 210, a cap sleeve 220, an end plate 230, and a fuel nozzle 100.

As shown in FIG. 2, the casing 210 forms an outer wall of the fuel nozzle assembly 100', has an inner space, and extends in one direction. The casing 210 is generally formed in a cylindrical shape. This shape is, however, exemplary only and not to be construed as a limitation of the present invention.

The cap sleeve 220 is disposed inside the casing 210 and formed along the extending direction of the casing 210. The cap sleeve 220 is separated from the inner wall of the casing 210 by an interposed space forming an annular duct 240. The cap sleeve 220 is generally formed in a cylindrical or tapered cylindrical shape, which is, however, exemplary only and not to be construed as a limitation of the present invention.

The end plate 230 is integrated with the casing 210 at one end of the casing 210 to seal the casing 210. Further, the end plate 230 may be combined with a manifold for supplying fuel to a central body 110 of the fuel nozzle 100 and to associated valves and the like. In addition, the end plate 230 supports the plurality of fuel nozzles 100 arranged in the casing 210.

Air compressed in the compressor 10 flows through a passage, i.e., the annular duct 240 between the casing 210 and the cap sleeve 220, and moves along the annular duct 240 until reaching the end plate 230 disposed at the end of the casing 210. Then, the compressed air turns approximately 180 degrees in the opposite direction (i.e., essentially a U-turn) and flows into each fuel nozzle 100.

When the compressed air is thus redirected to enter each fuel nozzle 100, airflow may be slowed inside of a fuel nozzle 100 and thereby an air pocket may be created. It is necessary to prevent this phenomenon.

Figure 3:
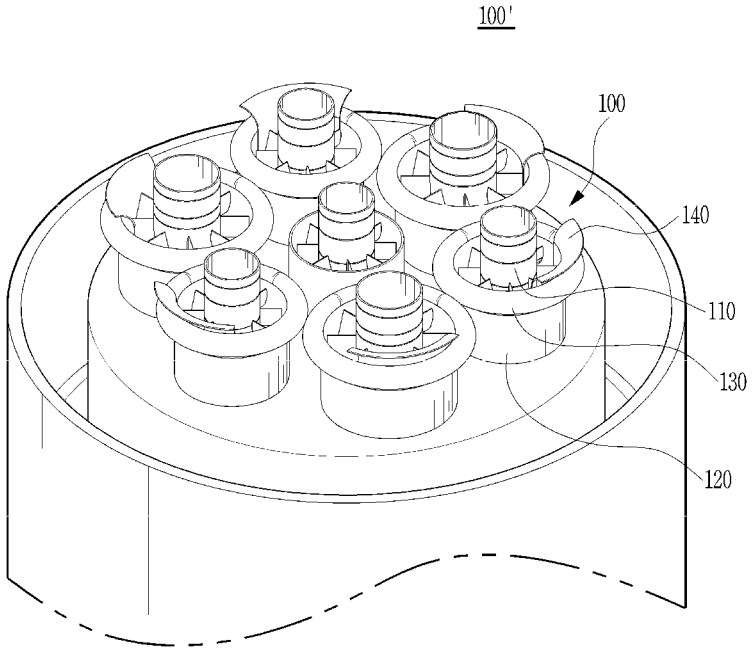
FIG. 3 is a perspective view showing a fuel nozzle assembly including a fuel nozzle according to an embodiment of the present invention.

As shown in FIG. 3, the fuel nozzle assembly 100' includes a plurality of the fuel nozzles 100 arrange in an array. In general, a number of fuel nozzles may be arranged radially around a centrally disposed fuel nozzle. The fuel nozzle 100 of FIG. 4 may be any one of the array, but for illustrative purposes it may be assumed that the fuel nozzle 100 of the present invention is a radially arranged fuel nozzle.

Figure 4:
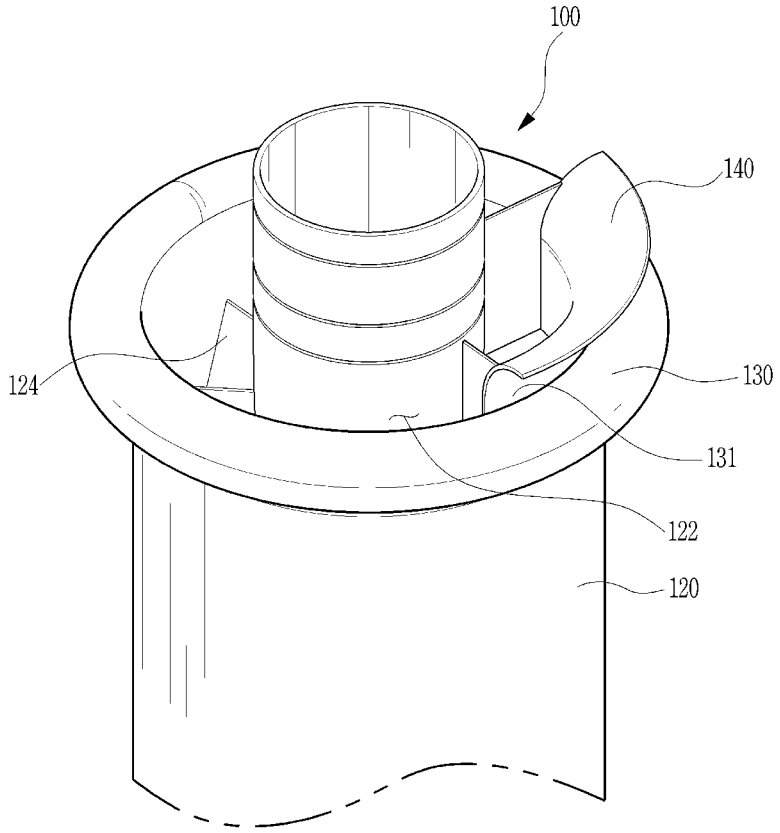
FIG. 4 is a perspective view showing a fuel nozzle according to an embodiment of the present invention.

Referring to FIGS. 2, 3, and 4, the fuel nozzle 100 includes a central body 110, a shroud 120, a rim 130, and a turning guide 140.

A fuel FF (FIG. 2) is injected through the central body 110. The fuel FF is supplied from a fuel supply unit, injected into a combustion chamber 250 through the central body 110 and a swirl vane 124, and burned in the combustion chamber 250 formed in a combustion liner (not shown). The combustion liner exposed to a hot combustion gas is cooled by relatively cool compressed air introduced through the annular duct 240. The central body 110 may be generally formed in a cylindrical shape, which is, however, exemplary only and not to be construed as a limitation of the present invention.

The shroud 120 is concentric with the central body 110 and extends along the longitudinal direction of the central body 110. The shroud 120 is spaced apart from the central body 110 and is formed to surround the central body 110. Air flows into a space formed between the central body 110 and the shroud 120. Although having any practical shape, the shroud 120 of this embodiment has a cylindrical shape which is concentric with the central body 110. In this case, a cross-section of an air passage 122 formed between the central body 110 and the shroud 120 has an annular shape.

The rim 130 is connected to an entrance of the shroud 120 and is formed along the periphery of the entrance to guide the air to the air passage 122. In order for the compressed air to smoothly enter the fuel nozzle 100 while changing directions, the rim 130 may have a convex curved surface. When each of the central body 110 and the shroud 120 is cylindrical, the rim 130 has an annular shape. An air inlet 131, through which the compressed air flows, is formed by the convex curved surface of the rim 130 and the juxtaposition of the rim 130 and one end of the central body 110.

Figure 5A:
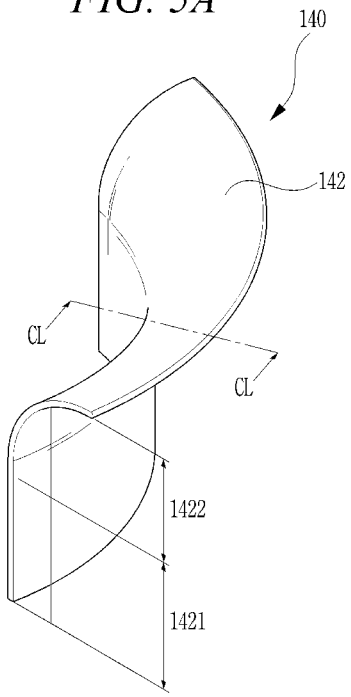
FIG. 5A is a perspective view showing a turning guide according to an embodiment of the present invention.
Figure 5B:
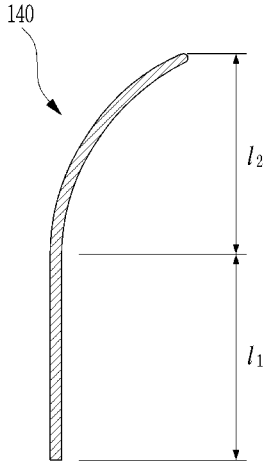
FIG. 5B is a cross-sectional view taken along line CL-CL of FIG. 5A.

The turning guide 140, which is shown in detail in FIGS. 5A and 5B, is disposed in the air inlet 131 and is arranged around a portion of surfaces of the shroud 120 and the rim 130. The turning guide 140 is spaced apart from both the shroud 120 and the rim 130. The turning guide 140 may be fixed to the central body 110, the rim 130, or the shroud 120 through a rib (not shown). The compressed air that reaches the air inlet 131 is introduced and distributed by the turning guide 140. That is, the turning guide 140 performs a function of distributing a flow of the air flowing into the air inlet 131, as illustrated in FIG. 2 and in more detail in FIG. 6.

Figure 6:
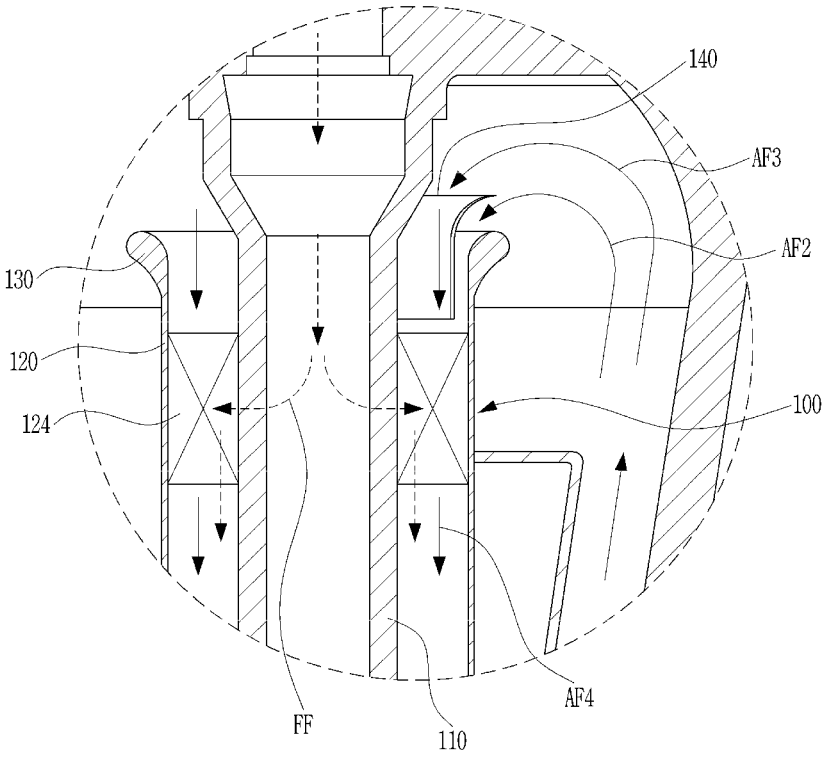
FIG. 6 is a cross-sectional view of a fuel nozzle according to an embodiment of the present invention, schematically showing a distributed flow of air flowing through an air inlet of the fuel nozzle.

Referring to FIGS. 2 and 6, when the compressed air is introduced into the air passage 122 of the fuel nozzle 100, an airflow AF1 is divided by the turning guide 140 into an airflow AF2 through a space between the rim 130 and the turning guide 140 and into an airflow AF3 through a space between the turning guide 140 and the central body 110.

When the turning guide 140 distributes the airflows AF2 and AF3, great airflow moment is created in the space between the rim 130 and the turning guide 140. Thus, the distribution of divided airflow can suppress the formation of an air pocket in the vicinity of the shroud 120, which is prone to form in the contemporary art.

A plurality of swirl vanes 124 are disposed on the outer circumferential surface of the central body 110 and are arranged at predetermined intervals around the central body 110. The turning guide 140 is spaced apart from the swirl vanes 124 so as prevent interference between the turning guide 140 and the swirl vanes 124. Specifically, the lower end of the turning guide 140 and the upper end of the swirl vane 124 are spaced apart from each other by a predetermined distance.

As shown in FIG. 5A, the turning guide 140 includes a turning separator 142 for separating the introduced airflow. The turning separator 142 is disposed to be spaced apart from both the shroud 120 and the rim 130 and is formed in a plate shape having a curved surface.

Specifically, the turning separator 142 may be divided into a lower portion 1421 facing the inner wall of the shroud 120 and an upper portion 1422 facing the outer surface of the rim 130. The lower portion 1421 of the turning separator 142 extends in the same direction as the extending directions of the central body 110 and the shroud 120, is spaced apart from the swirl vane 124, and may be disposed parallel to the inner wall of the shroud 120.

The upper portion 1422 of the turning separator 142 extends in the form of curved surface from the lower portion 1421 along the outer surface of the rim 130. That is, beginning from an upper end of the lower portion 1421, the upper portion 1422 of the turning separator 142 has a convex curved surface to correspond to a portion of the surface of the rim 130. The upper portion 1422 of the turning separator 142 may cover the rim 130 such that the surface facing the rim 130 is spaced apart from the outer surface of the rim 130. Although the upper portion 1422 of the turning separator 142 has an arc shape in this embodiment, this is exemplary only and not to be construed as a limitation of the present invention. Alternatively, the upper portion of the turning separator 142 may have various shapes.

Referring to FIG. 5B, a length $l_1$ of the lower portion 1421 of the turning separator 142 may be greater than or equal to a vertical component length $l_2$ of the upper portion 1422. When the compressed air moves along the annular duct 240 and reaches the end plate 230, the compressed air turns in the opposite direction (i.e., U-turn) and flows into the fuel nozzle 100. That is, the compressed air flows into a space between the turning separator 142 and the rim 130 and then flows along the air passage 122 formed by the shroud 120 and the central body 110. At this time, if the length $l_1$ of the lower portion 1421 of the turning separator 142 is short, the airflow distribution effect of the turning separator 142 may be weakened. Therefore, in order to maximize the effect of distributing the airflow between the turning separator 142 and the rim 130, the length $l_1$ of the lower portion 1421 of the turning separator 142 may be greater than or equal to the length $l_2$ of the upper portion 1421 of the turning separator 142.

Figure 7A:
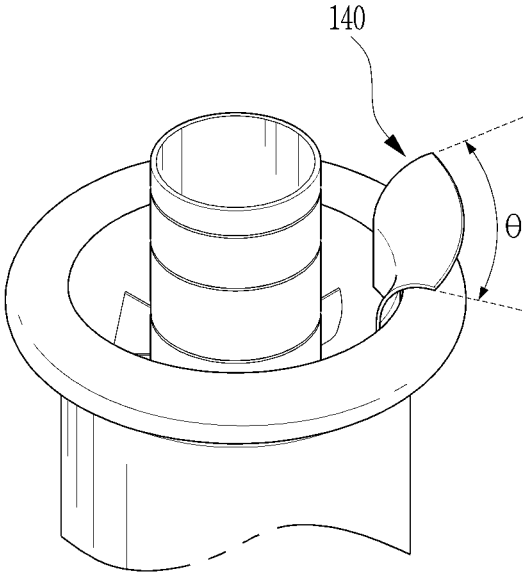
FIGS. 7A and 7B are perspective views of a fuel nozzle according to the present invention, respectively showing turning separators according to range of coverage.
Figure 7B:
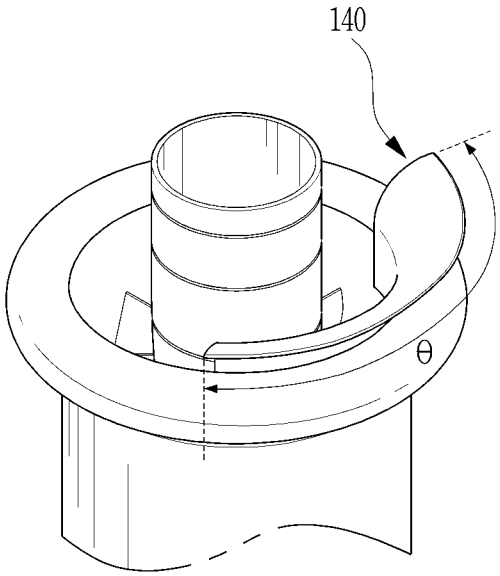
Figure 10A:
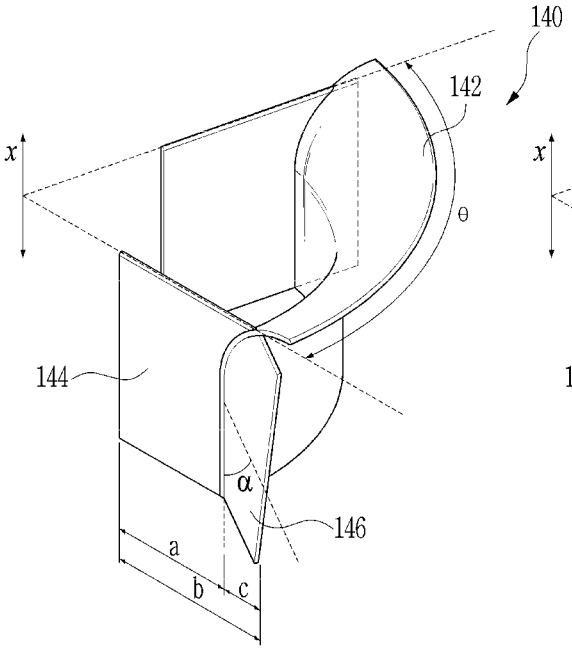
FIGS. 10A and 10B are perspective views of a turning guide according to the present invention, respectively showing inner and outer separators according to inclination angle.
Figure 10B:
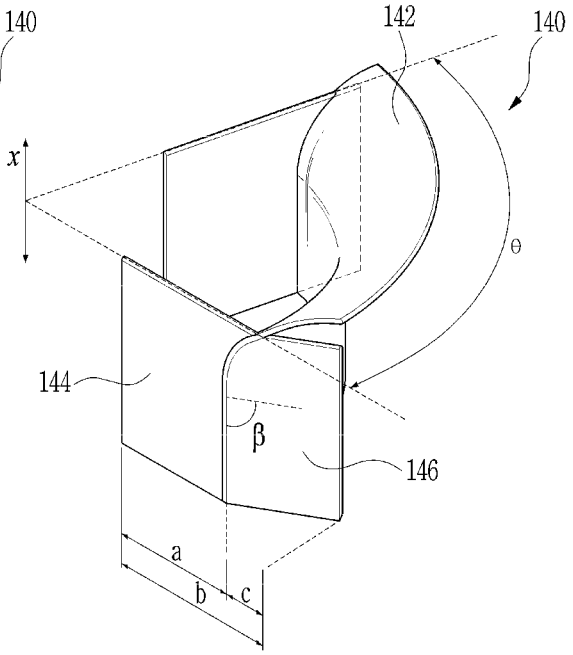

In addition, as shown in FIGS. 7A and 7B, a range of coverage of the turning separator 142 formed in the air inlet 131 may vary and may be expressed as an angle θ in a circumferential direction of the turning separator 142 with respect to a central axis x (FIGS. 10A and 10B). The coverage range may be a little as 40 degrees or as much as 240 degrees and is preferably 60 to 140 degrees. A coverage range of 60 degrees around the central axis x of the central body 110 is exemplified in FIG. 7A and a coverage range of 140 degrees is exemplified in FIG. 7B.

If the coverage range of the turning separator 142 is less than 40 degrees, the amount of incoming air divided by the turning separator 142 is small, weakening the airflow distribution effect. On the other hand, if the range of the turning separator 142 is greater than 240 degrees, an undesirable interference of the airflow may occur between neighboring fuel nozzles 100 in the fuel nozzle assembly 100' in which plural fuel nozzles 100 are annularly arranged. Here, when the fuel nozzles 100 are disposed radially about one fuel nozzle in the fuel nozzle assembly 100', the turning guide 140 of each fuel nozzle 100 may be disposed at the outermost position of each fuel nozzle 100 in order to minimize interference by adjacent fuel nozzles 100.

Figure 8:
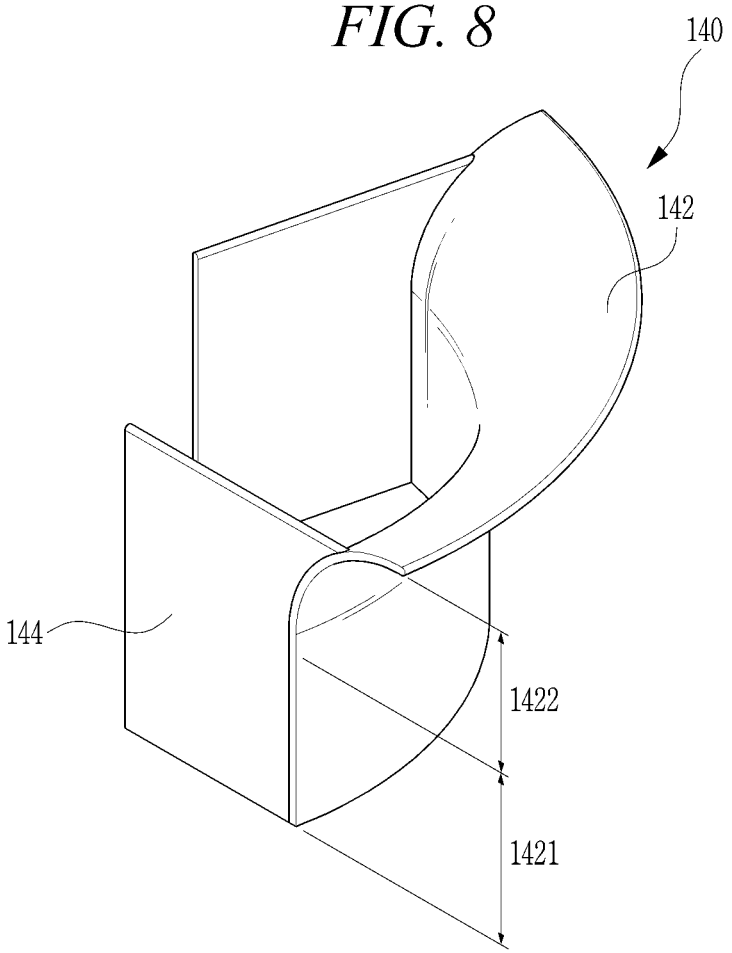
FIG. 8 is a perspective view of a turning guide having inner separators according to an embodiment of the present invention.

Referring to FIG. 8, the turning guide 140 may further include an inner separator 144. That is, at least one inner separator 144 is disposed at a lateral end of the turning separator 142. The lateral ends of the turning separator 142 are situated with respect to the circumferential direction, and the inner separator 144 extends inwardly from the turning separator 142 in the radial direction. The inner separator 144 may be in the form of a single inner separator 144 disposed at one lateral end of the turning separator 142, or a pair of inner separators 144 disposed at both lateral ends of the turning separator 142. In addition, the inner separator 144 may be formed in a plate shape extending from a corresponding lateral end of the turning separator 142 to the outer surface of the central body 110. The inner separator 144 may block the air flowing into the space between the turning separator 142 and the central body 110 from fluctuating inwardly and outwardly in the circumferential direction of the turning separator 142, thereby maintaining the airflow more uniformly.

An inward end of the inner separator 144 may be connected to the outer surface of the central body 110. Although the inner separator 144 is shown as being connected to both lateral ends of the turning separator 142 in this embodiment, this is exemplary only and not to be construed as a limitation. Alternatively, the inner separator 144 may be connected to only one lateral end of the turning separator 142 or to any position of the turning separator 142 other than the lateral ends in the circumferential direction.

When the compressed air flows into the air passage 122 of the fuel nozzle 100, this airflow may be divided by the inner separator 144 in addition to the turning separator 142.

Figure 9:
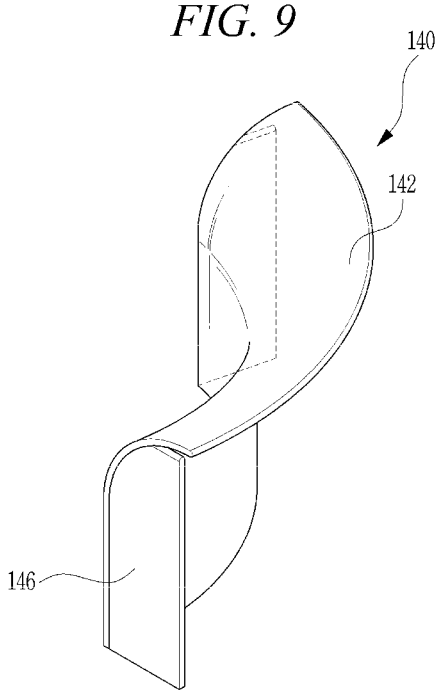
FIG. 9 is a perspective view of a turning guide having outer separators according to an embodiment of the present invention.

According to another embodiment, as shown in FIG. 9, the turning guide 140 may further include an outer separator 146 instead of the inner separator 144. As in the case of the inner separators 144, one or two outer separators 146 are connected to one or both lateral ends of the turning separator 142 in the circumferential direction and extend outwardly from the turning separator 142 in the radial direction. Also like the inner separator 144, the outer separator 146 is formed in a plate shape. The outer separator 146 may block the air flowing into the space between the turning separator 142 and the shroud 120 from fluctuating inwardly and outwardly in the circumferential direction of the turning separator 142.

An outward end of the outer separator 146 may be connected to an inner surface of the shroud 120. Although the outer separator 146 is shown as being connected to both lateral ends of the turning separator 142 in this embodiment, this is exemplary only and not to be construed as a limitation. Alternatively, the outer separator 146 may be connected to only one lateral end of the turning separator 142 or to any position of the turning separator 142 other than the lateral ends in the circumferential direction.

Accordingly, the turning guide 140 of FIG. 8 or 9 further includes at least one plate-shaped separator 144 or 146 connected to a lateral end of the turning separator 142 and extending from the turning separator 142 in a radial direction.

Meanwhile, the outer separator 146 may be formed at an increased angle with respect to the turning separator 142 in the circumferential direction. That is, as shown in FIG. 10A, the outer separator 146 may be formed to be tilted outwardly at a certain angle ($\alpha$) in the circumferential direction of the turning separator 142. In other words, the outer separator 146 may be formed to have an increased angle ($\alpha$) in comparison with the angle ($\theta$) of the turning separator 142 in the circumferential direction. The tilt angle ($\alpha$) of the outer separator 146 may be 0 to 10 degrees. When the outer separator 146 is formed to be tilted outwardly with respect to the turning separator 142, it is possible to change the direction of the airflow.

However, if the outer separator 146 is tilted outwardly at an angle of more than 10 degrees with respect to the turning separator 142, the outer separator 146 may interfere with the flow of the introduced compressed air. This is undesirable.

Alternatively, the outer separator 146 may be formed at a reduced angle with respect to the turning separator 142 in the circumferential direction. That is, as shown in FIG. 10B, the outer separator 146 may be formed to be tilted inwardly at a certain angle ($\beta$) in the circumferential direction of the turning separator 142. In other words, the outer separator 146 may be formed to have a reduced angle ($\beta$) in comparison with the angle ($\theta$) of the turning separator 142 in the circumferential direction. The tilt angle ($\beta$) of the outer separator 146 may be 0 to 10 degrees. When the outer separator 146 is formed to be tiled inwardly with respect to the turning separator 142, the compressed air may further flow into the space between the central body 110 and the turning guide 140. However, if the outer separator 146 is tilted inwardly at an angle of more than 10 degrees with respect to the turning separator 142, the airflow passage may be narrowed by the outer separator 146. This is undesirable because of the disruption of the smooth flow of air.

As above, by adjusting the tilt angle of the outer separator 146 inwardly or outwardly from the turning separator 142, it is possible to finely adjust the airflow.

Figure 11A:
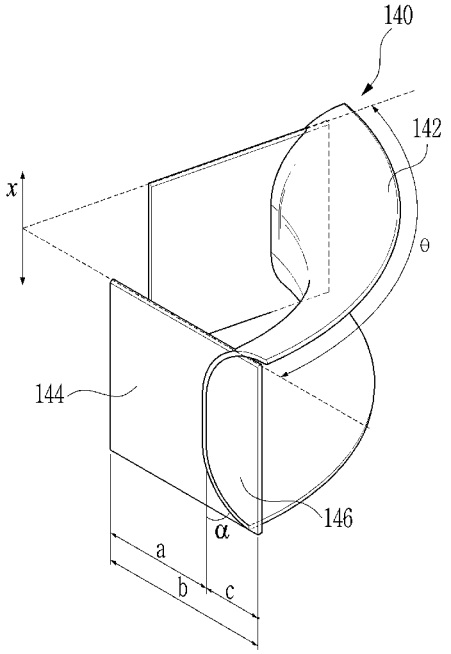
FIGS. 11A and 11B are perspective views of a turning guide according to the present invention, respectively showing turning separators according to the inclination direction of a lower portion.
Figure 11B:
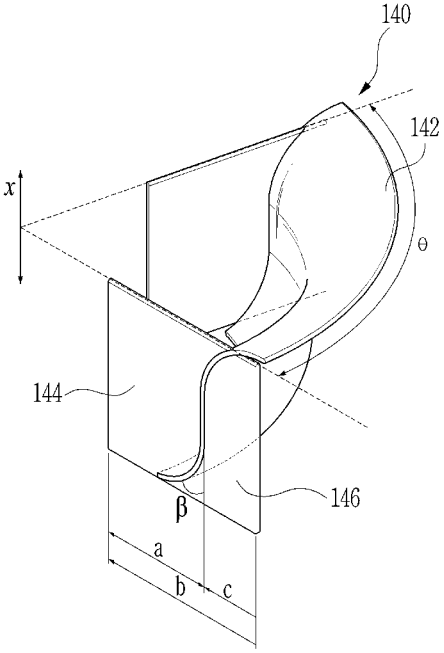

In addition, as shown in FIGS. 11A and 11B, the lower portion 1421 of the turning separator 142 may be formed to incline or curve toward the central body 110 or toward the shroud 120, that is, inwardly or outwardly. Specifically, when the inner separator 144 is formed in a plate-like shape extending toward or away from the central axis x of the central body 110, the lower portion 1421 of the turning separator 142 may be bent toward or away from the central body 110, that is, to become farther from or closer to the shroud 120. More specifically, the lower end of the lower portion 1421 of the turning separator 142 may be formed to have an inward inclination angle ($\alpha$) toward the central body 110 or an outward inclination angle ($\beta$) toward the shroud 120 with respect to the central axis x of the central body 110. Each of these angles ($\alpha$, $\beta$) may be from 0 to 10 degrees.

As above, by adjusting the lower portion 1421 of the inner separator 146 inwardly or outwardly from the central axis of the central body 110, it is possible to adjust the airflow with very effective manner.

The turning guide 140 may include both the inner separator 144 and the outer separator 146. As described above, the inner separator 144 is connected to at least one lateral end of the turning separator 142 and extends inwardly in the radial direction, whereas the outer separator 146 is connected to at least one lateral end of the turning separator 142 and extends outwardly in the radial direction.

The inner separator 144 and the outer separator 146 have a specific length ratio. Specifically, the horizontal length (a) of a downstream end of the inner separator 144 and the horizontal length (c) of a downstream end of the outer separator 146 may have a ratio of 4:1 to 1:1. That is, the horizontal length (a) of the downstream end of the inner separator 144 may be greater than or equal to the horizontal length (c) of the downstream end of the outer separator 146. Therefore, within the passage formed by the outer surface of the central body 110 and the inner surface of the shroud 120, the lower portion of the turning separator 142 is positioned midway in the passage or in the passage closer to the shroud 120.

When the horizontal length (c) of the downstream end of the outer separator 146 is relatively small, a greater amount of air is introduced into the space between the turning guide 140 and the central body 110. On the other hand, when the horizontal length (c) of the downstream end of the outer separator 146 is increased, the amount of air flowing into the space between the turning guide 140 and the shroud 120 increases. If the horizontal length (c) of the downstream end of the outer separator 146 is greater than the horizontal length (a) of the downstream end of the inner separator 144, the amount of the air flowing into the space between the central body 110 and the turning guide 140 is insufficient. This is undesirable because the air is not flowing smoothly.

Figure 12:
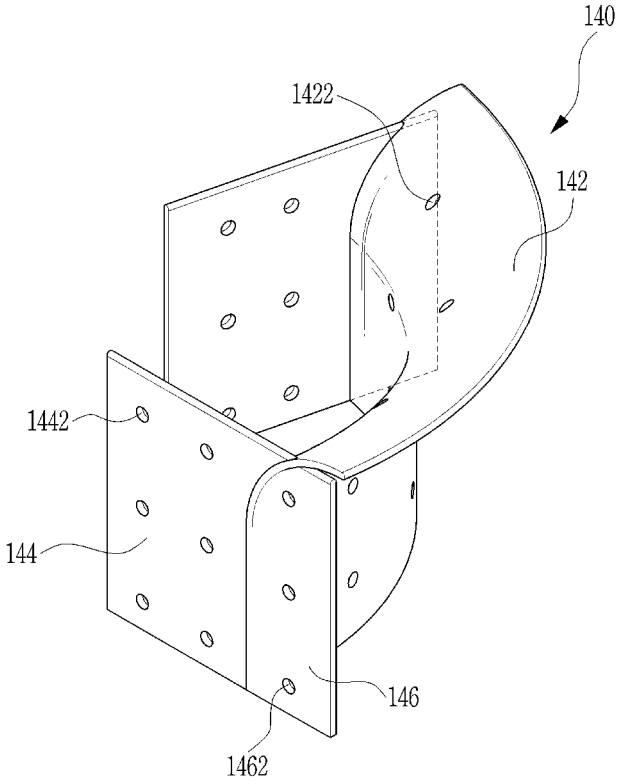
FIG. 12 is a perspective view of a turning guide having openings according to an embodiment of the present invention.

According to still another embodiment, as shown in FIG. 12, openings 1422, 1442, and 1462 may be formed in the turning separator 142, the inner separator 144, and the outer separator 146. The compressed air that is introduced while being divided by the turning guide 1400 moves in and out through the openings 1422, 1442, and 1462, thereby being distributed more uniformly. Therefore, the compressed air can remove an air pocket while flowing from a place having a high air density to a place having a low air density.

The openings 1422, 1442, and 1462 may be formed in at least one of the turning separator 142, the inner separator 144, and the outer separator 146. That is, the openings may be formed in all three separators as needed, or may be selectively formed only in one or two separators. In addition, the openings may be formed over the entire area of the turning guide 140 without any limitation of their positions.

Figure 13A:
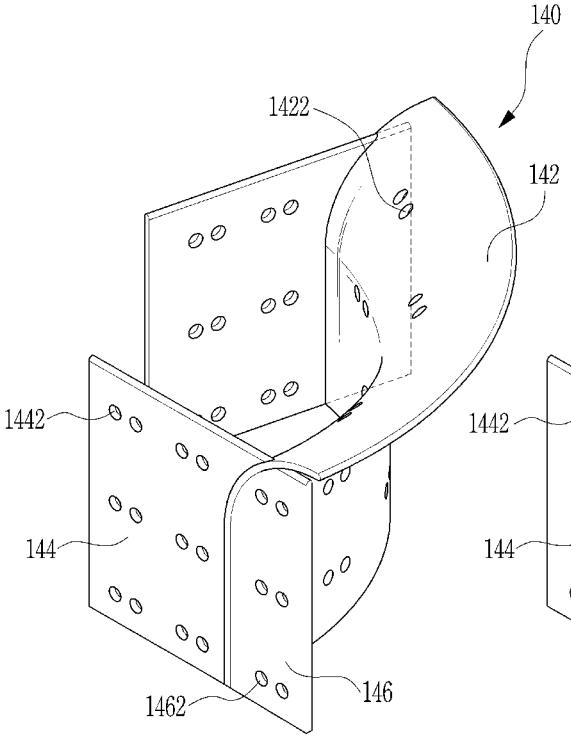
FIGS. 13A and 13B are perspective views of a turning guide according to the present invention, respectively showing openings formed in the turning separators according to pattern.
Figure 13B:
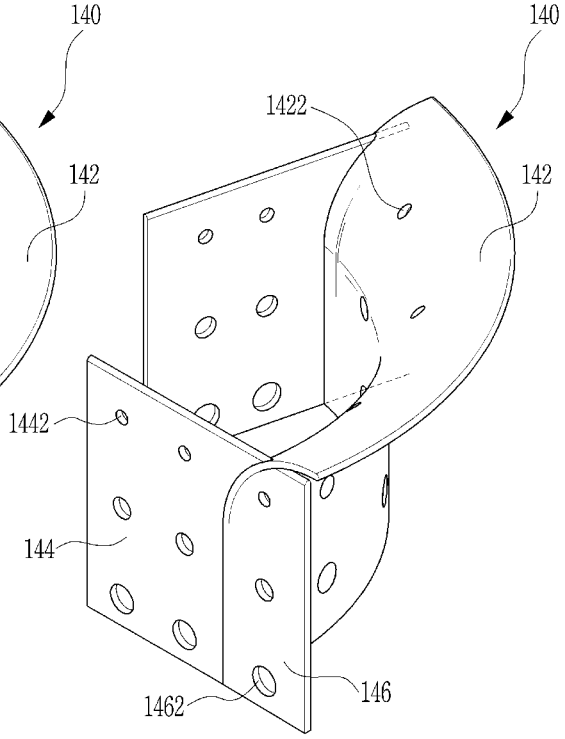

The openings 1422, 1442, and 1462 arranged in the turning guide 140 may be formed with a specific pattern. For example, as shown in FIG. 13A, the openings 1422, 1442, and 1462 may be formed at regular intervals in the horizontal or vertical direction, or may be formed in a specific shape. In another example, the openings 1422, 1442, and 1462 may be formed to have different sizes in the horizontal or vertical direction. When the sizes of the openings 1422, 1442, and 1462 become larger toward a lower side of either of the inner and outer separators 144 and 146, as shown in FIG. 13B, the movement of the compressed air through the openings 1422, 1442, and 1462 may be increased as the air flows downward along the turning guide 140. In other words, the turning guide 140 has at least one opening arranged according to an airflow travel distance along a surface of one or both of the inner and outer separators 144 and 146.

Figure 14A:
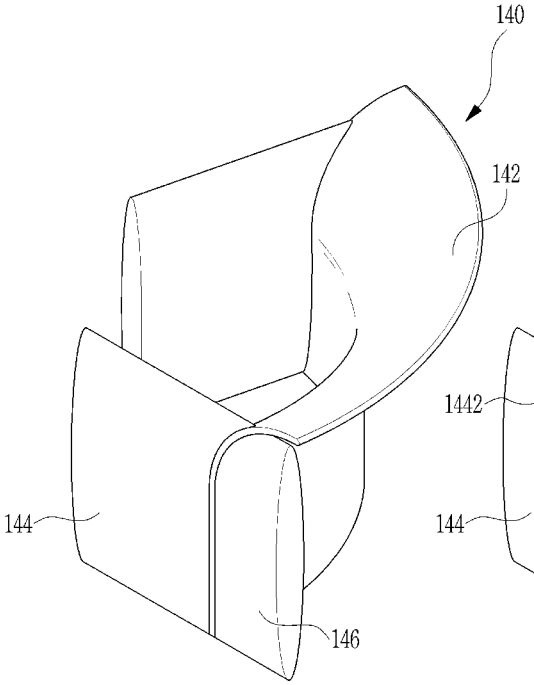
FIGS. 14A and 14B are perspective views of a turning guide having inner and outer separators with curved surfaces according to an embodiment of the present invention, respectively showing the separators with and without openings.
Figure 14B:
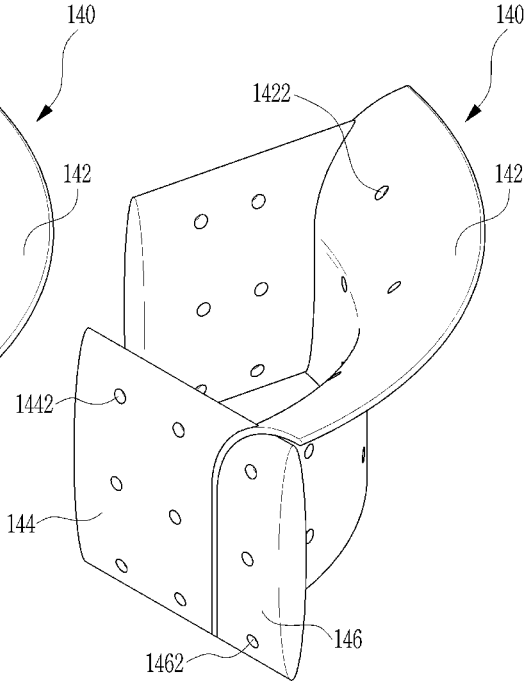

According to yet another embodiment, as shown in FIGS. 14A and 14B, each of the inner separator 144 and the outer separator 146 may have a curved surface. That is, rather than formed with a flat surface as described above, at least one of the inner separator 144 and the outer separator 146 may be formed with a curved surface having a convex middle portion to impart a streamlined shape. This may control the separation of airflow around the inner separator 144 and the outer separator 146 and thereby prevent any unnecessary drop of pressure. Even in the inner and outer separators 144 and 146 formed with a curved surface, the above-described openings 1442 and 1462 may be formed respectively.

Figure 15:
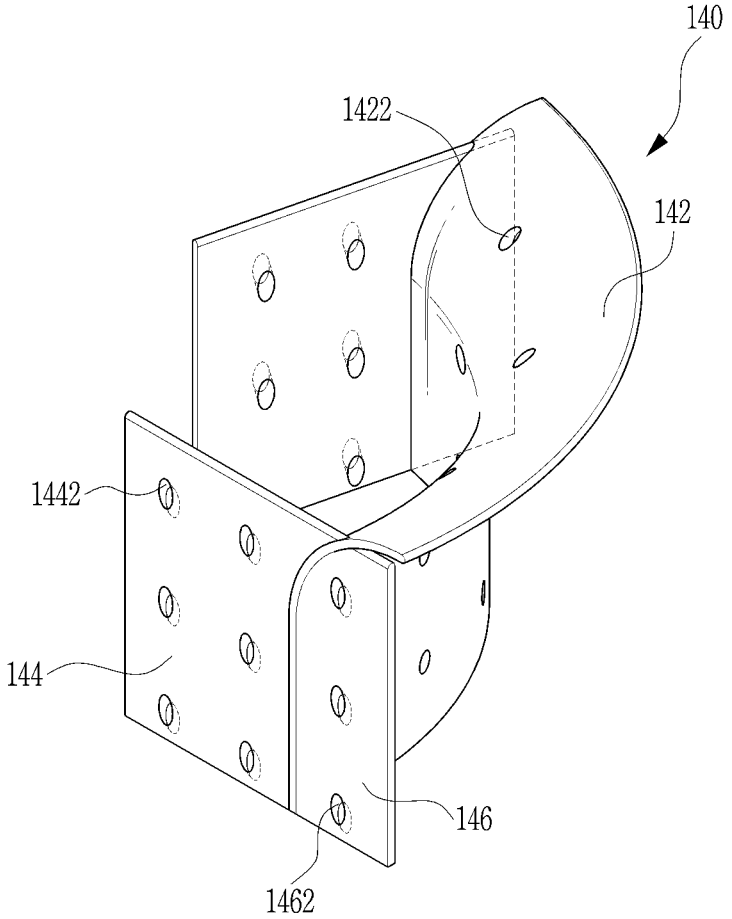
FIG. 15 is a perspective view of a turning guide having obliquely angled openings according to an embodiment of the present invention.

Normally, the openings 1422, 1442, and 1462 are formed perpendicular to the surface of the corresponding separator. However, as shown in FIG. 15, the openings 1422, 1442, and 1462 may be formed at an oblique angle with respect to the surface of the corresponding separator. With the openings 1422, 1442, and 1462 thus formed at an oblique angle, the air passing through the openings 1422, 1442, and 1462 has a directionality since each separator itself has a certain thickness. For example, if the openings 1422, 1442, and 1462 are formed obliquely in a downward and inward direction, the air flowing into the turning guide 140 from the outside of the turning guide through the openings 1422, 1442, and 1462 may have a downward stream. The directionality of the airflow may prevent the creation of any undesirable air pocket.

According to the present invention as described above, when the compressed air flows into the fuel nozzle assembly, it is possible to make the airflow uniform, thereby suppressing the creation of an air pocket. Since the compressed air is more uniformly supplied to the fuel nozzle, the gas can be stably burned, and thereby the generation of nitrogen oxides can be reduced. It is also possible to prevent a local increase of combustion temperature which may result in the generation of a flame inside the fuel nozzle and damage to fuel nozzle components.

While the present disclosure has been particularly shown and described with reference to exemplary embodiments thereof, it is clearly understood that the same is by way of illustration and example only and is not to be taken in conjunction with the present disclosure. It will be understood by those skilled in the art that various changes in form and details may be made therein without departing from the subject matter and scope of the present disclosure.

What is claimed is:

1. A fuel nozzle comprising:

a central body having an outer wall;

a shroud concentrically disposed with respect to the central body and configured to surround the central body while maintaining a space for an air passage between an inner wall of the shroud and the outer wall of the central body;

a rim formed on one end of the shroud, the rim forming an air inlet that introduces an airflow to the shroud and communicates with the air passage; and a turning guide that is disposed in the air inlet and includes a turning separator, wherein the turning separator includes a lower portion having a first axial end and a second axial end and an upper portion and extends in a circumferential direction of the shroud, the upper portion extending in an axial direction of the shroud from the second axial end of the lower portion and including a convex surface to correspond to an outer surface of the rim, the turning separator further including a pair of opposing plates respectively formed at a first circumferential end of the turning separator and a second circumferential end of the turning separator to separate the airflow in the air passage in the circumferential direction, and wherein each of the pair of opposing plates extends in a radial direction of the shroud from the turning separator to the outer wall of the central body and extends in the axial direction from the first axial end of the lower portion of the turning separator to the convex surface of the upper portion of the turning separator.

2. The fuel nozzle of claim 1, further comprising:

a plurality of swirl vanes disposed at a specific interval on an outer circumferential surface of the central body.

3. The fuel nozzle of claim 1, wherein the turning separator has an angle of coverage of the rim, the angle of coverage being set by the first circumferential end and the second circumferential end with respect to a central axis of the central body, wherein the turning separator terminates in the circumferential direction at either of the first circumferential end and the second circumferential end, wherein the first circumferential end is separated from the second circumferential end by more than 60 degrees in the circumferential direction, and wherein the second circumferential end is separated from the first circumferential end by less than 140 degrees in the circumferential direction.

4. A turning guide disposed in a fuel nozzle including a central body, a shroud surrounding the central body, and a rim formed on one end of the shroud, the rim forming an air inlet that introduces an airflow to the shroud, the turning guide comprising:

a turning separator, disposed in the air inlet and arranged along a circumferential direction of the air inlet, including a lower portion having a first axial end and a second axial end facing an inner wall of the shroud and an upper portion facing an outer surface of the rim, the upper portion extending in an axial direction of the shroud from the second axial end of the lower portion and including a convex surface to correspond to an outer surface of the rim, wherein the turning separator extends in a circumferential direction of the shroud and further includes a first circumferential end, a second circumferential end, and a pair of opposing plates respectively formed at the first circumferential end and the second circumferential end to separate the airflow in the air passage in the circumferential direction, each of the pair of opposing plates extending in a radial direction of the shroud from the turning separator to the outer wall of the central body and extending in the axial direction from the first axial end of the lower portion of the turning separator to the convex surface of the upper portion of the turning separator.

5. The turning guide of claim 4, wherein the turning separator has an angle of coverage of the rim, the angle of coverage being set by the first circumferential end and the second circumferential end with respect to a central axis of the central body, wherein the turning separator terminates in the circumferential direction at either of the first circumferential end and the second circumferential end, wherein the first circumferential end is separated from the second circumferential end by more than 60 degrees in the circumferential direction, and wherein the second circumferential end is separated from the first circumferential end by less than 140 degrees in the circumferential direction.

6. A gas turbine comprising:

a compressor for compressing incoming air to form compressed air;

a combustor for mixing fuel with the compressed air to form a mixture and burning the mixture, the combustor including a combustion chamber and a fuel nozzle assembly disposed in the combustion chamber; and a turbine for generating a turning force by a combustion gas received from the combustor, wherein the fuel nozzle assembly includes a plurality of fuel nozzles, each fuel nozzle including:

a central body having an outer wall;

a shroud concentrically disposed with respect to the central body and configured to surround me central body while maintaining a space for an air passage between an inner wall of the shroud and the outer wall of the central body;

a rim formed on one end of the shroud, the rim forming an air inlet that introduces the compressed air to the shroud and communicates with the air passage; and a turning guide that is disposed in the air inlet and includes a turning separator, wherein the turning separator includes a lower portion having, a first axial end and a second axial end and an upper portion and extends in a circumferential direction of the shroud, the upper portion extending in an axial direction of the shroud from the second axial end of the lower portion and including a convex surface to correspond to an outer surface of the rim, the turning separator further including a pair of opposing plates respectively formed at a first circumferential end of the turning separator and a second circumferential end of the turning separator to separate the airflow in the air passage in the circumferential direction, and wherein each of the pair of opposing plates extends in a radial direction of the shroud from the turning separator to the outer wall of the central body and extends in the axial direction from the first axial end of the lower portion of the turning separator to the convex surface of the upper portion of the turning separator.

* * * * *